United States Patent [19]

Kupper

[11] Patent Number: 4,830,171

[45] Date of Patent: May 16, 1989

[54] APPARATUS FOR PROVIDING A CONSTANT BOBBIN TUBE SUPPLY

[75] Inventor: Wilhelm Kupper, Wegberg, Fed. Rep. of Germany

[73] Assignee: W. Schlafhorst & Co., Fed. Rep. of Germany

[21] Appl. No.: 91,581

[22] Filed: Aug. 31, 1987

[30] Foreign Application Priority Data

Aug. 3, 1986 [DE] Fed. Rep. of Germany ..... 3629561

[51] Int. Cl.[4] ..... B65G 47/10

[52] U.S. Cl. ..... 198/357; 198/370; 198/580; 198/503; 198/358; 242/35.5 A

[58] Field of Search ..... 198/356–358, 198/370, 362, 580, 524, 464.3, 487.1, 503, 11; 242/35.5 A

[56] References Cited

U.S. PATENT DOCUMENTS

| | | | |
|---|---|---|---|
| 3,358,940 | 12/1967 | Beckwith et al. | 198/358 |
| 4,063,635 | 12/1977 | Heckel | 242/35.5 A |
| 4,238,025 | 12/1980 | Manservisi | 198/370 |
| 4,724,666 | 2/1988 | Kupper | 242/35.5 A |

FOREIGN PATENT DOCUMENTS

| | | | |
|---|---|---|---|
| 3445678 | 6/1986 | Fed. Rep. of Germany | 198/357 |
| 27825 | 2/1986 | Japan | 198/464.3 |

*Primary Examiner*—Joseph E. Valenza

*Attorney, Agent, or Firm*—Shefte, Pinckney & Sawyer

[57] ABSTRACT

An apparatus for providing a constant supply of circulating textile bobbin tubes from a delivery conveyor of a textile winding machine to a return conveyor of a textile spinning machine. A reserve magazine containing textile bobbin tubes is combined with an accumulating magazine through which tubes are received from a winder and discharged for feeding to a spinning machine, with the reserve magazine discharging tubes to a transfer conveyor whenever there is an absence of supply of tubes from the accumulating magazine. An overflow collector collects tubes received from the winder in excess of the number necessary to maintain the accumulating magazine full, with the overflow of tubes being transferred manually or automatically to the reserve magazine. Discharge from the magazines is controlled by a sensor that senses the supply of tubes to the spinning machine and by sensors that sense the advance of the transfer conveyor and the presence or absence of a tube on the transfer conveyor adjacent the reserve magazine.

12 Claims, 1 Drawing Sheet

APPARATUS FOR PROVIDING A CONSTANT BOBBIN TUBE SUPPLY

BACKGROUND OF THE INVENTION

The present invention relates to automatic textile spinning and winding, and more particularly to apparatus for providing a constant supply of circulating bobbin tubes between automatic textile winding and spinning machines.

Automatic textile spinning machines conventionally utilize for operation a supply of at least twice as many bobbin tubes as there are spindles and automatic textile winding machines conventionally utilize for operation a supply of at least twice as many bobbin tubes as there are winding stations. In addition, generally 40 to 60 tubes are needed in the automatic circulation path between winders and spinning machines as a compensating reserve to accommodate fluctuations in supply and demand.

In the combined operation of spinning machines and winders, yarn is spun and wound into bobbins on tubes at the spinning machine, the bobbins are conveyed to the winder and unwound from the tubes with the yarn wound into packages, and the empty tubes are conveyed to the spinning machine for reuse. For efficient operation an uninterrupted supply of tubes must be available for feeding to the spinning machine and an uninterrupted discharge of tubes from the winder must be provided, and this should be done in a manner that continues the supply of tubes to the spinning machine when the winder is temporarily stopped and continues to allow discharge of tubes from the winder when the spinning machine is temporarily stopped so that interruption in operation of one will not interfere with continued operation of the other.

Also, during such combined spinning machine and winder operations damaged tubes, incompletely wound bobbins, and tubes on which yarn could not be caught are removed from circulation, reducing the number of tubes in circulation until they are repaired and returned or other bobbins substituted at periodic intervals. This requires a reserve of tubes in the circulating system that is sufficient to accommodate expected depletion due to removal of malfunctioned tubes and to accommodate periodic replenishment of tubes in batches.

SUMMARY OF THE INVENTION

The present invention provides an apparatus that maintains, within reasonable limits, a sufficient continuous supply of tubes to maintain operation of a spinning machine and winder operating in combination without interruption in operation of one effecting operation of the other and accommodating removal of individual malfunctioning tubes and periodic insertion of batches of repaired or replacement tubes.

Briefly described the apparatus of the present invention provides a constant supply of circulating textile bobbin tubes from a delivery conveyor of a textile winding machine to a return conveyor of a textile spinning machine. A transfer conveyor is provided for transferring tubes from the delivery conveyor to the return conveyor. A tube accumulating magazine is disposed adjacent the transfer conveyor for receipt and accumulation of tubes delivered thereto by the delivery conveyor. Means discharge tubes singly from the accumulating magazine onto the transfer conveyor. Means are provided for discharging tubes singly from the accumulating magazine onto the transfer conveyor. A tube reserve magazine is disposed adjacent the transfer conveyor downstream of the accumulating conveyor for containing a reserve supply of tubes. Means are provided for discharging tubes singly from the reserve magazine onto the transfer conveyor. Means are provided for sensing the supply of tubes on the return conveyor and for rendering the accumulating magazine discharging means and the reserve magazine discharging means operable in response to a reduction in the supply tubes on the return conveyor. Means are provided for activating operation of the accumulating magazine discharging means in timed relation to advance of the transfer conveyor when the discharging means is rendered operable. Means are provided for activating operation of the reserve magazine discharging means in response to the absence of discharge of a tube onto the transfer conveyor upon operation of the accumulating magazine discharging means.

With this apparatus a back-up of tubes on the delivery conveyor from the winder is avoided so that winder operation need not be interrupted because of an accumulation of tubes due to a temporary interruption in the operation of the spinning machine. On the other hand, the tube accumulating magazine and the tube reserve magazine provide a sufficient temporary excess supply of tubes to accommodate continuing operation of the spinning machine during temporary interruptions in operation of the winding machine. Further, the reserve magazine enhances efficiency of operation by allowing greater time intervals and larger replenishment batches in periodically replenishing the tube supply.

Preferably, means are provided for collecting the overflow of tubes from the delivery conveyor when the accumulating magazine is full. Thus, when the accumulating magazine is full due to a temporary stopped of the spinning machine or malfunction in the discharge of tubes from the accumulating magazine, operation of the winder can continue. This overflow collection means can be manually emptied into the reserve magazine or can itself be part of the reserve magazine. Thus, a full supply of tubes will be available when circulation to the spinning machine resumes or circulation can continue in a situation where the discharge of tubes from the accumulating magazine is malfunctioning.

In the preferred embodiment, the means for activating operation of the reserve magazine discharging means in response to the absence of a tube on the transfer conveyor acts in delayed timed relation to advance of the transfer conveyor from the accumulating magazine to the reserve magazine. In this case the transfer conveyor is a compartmented conveyor having compartments for individual tubes, and the delayed activating means includes means for sensing the absence of a tube in a compartment of the transport conveyor between the accumulating magazine discharging means and the reserve magazine discharging means. With this arrangement the discharge of tubes from the accumulating magazine takes precedence over delivery of tubes from the reserve magazine, which latter does not occur until the supply of tubes from the accumulating magazine is exhausted or otherwise unable to maintain pace with the advance of the transfer conveyor.

Preferably means are included for advancing the transfer conveyor in response to the means for sensing the supply of tubes on the return conveyor. The purpose of this is to stop the transfer conveyor when the supply of tubes on the return conveyor is full, thereby avoiding oversupply of tubes to the return conveyor.

In the preferred embodiment the reserve magazine, which preferably includes a removable container, has a slot and includes a movable inclined bottom portion adjacent the slot, with means for vibrating the movable bottom portion to facilitate movement of tubes from the bottom portion through the slot. Means may be provided for selectively closing the slot as when the magazine is serving also as an overflow container for tubes from the return conveyor with the container being moved from overflow receiving position with the slot closed to the reserve magazine where the slot is open for discharge of tubes.

To provide for initial charging of the spinning machine, winder and circulating systems with tubes, initial activating means are provided for activating operation of the reserve magazine discharging means, and a counter is provided that is operable to de-activate this initial activating means upon counting the discharge of a selected number of tubes. Thus, tubes will be fed from the reserve magazine until the proper number of tubes are in circulation and then the apparatus will function in the continuous manner described above. Preferably, the counter is mounted adjacent the reserve magazine for counting tubes passing therethrough and for de-activation of the reserve magazine discharging means with a selected supply of tubes remaining in the magazine to provide the tube reserve desired for the continuous operation of the system described above.

Further features and advantages of the present invention will be apparent from the accompanying drawings and the following detailed description.

DETAILED DESCRIPTION OF THE PREFERRED EMBODIMENT

Figures 1, 2:
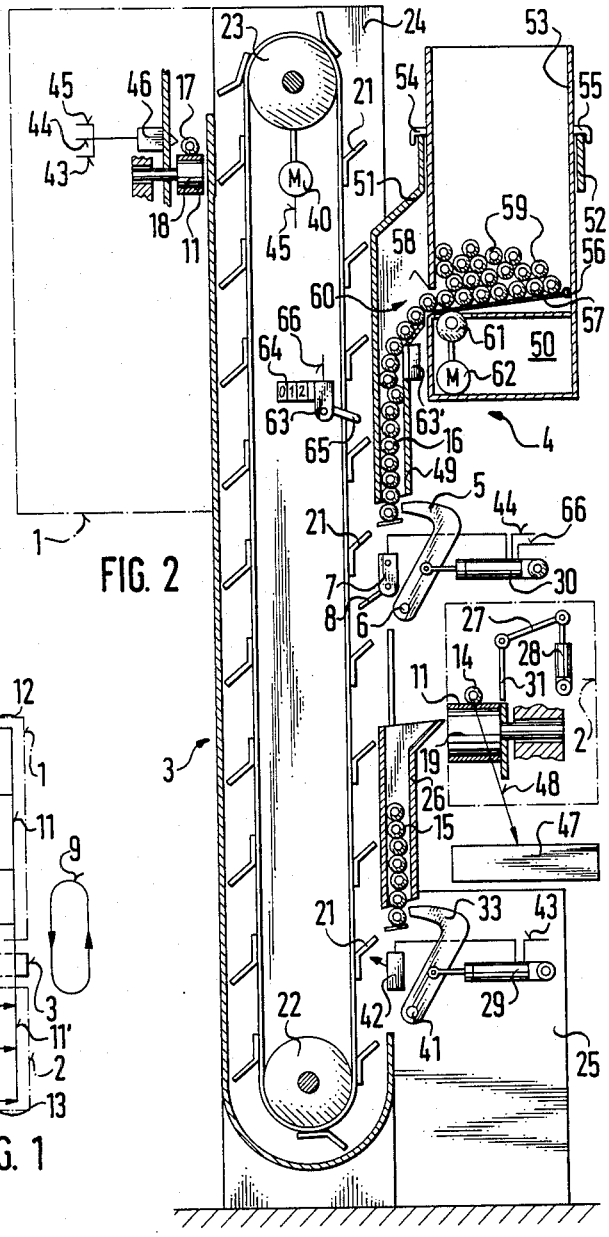
FIG. 1 is a schematic illustration of the system of circulating tubes in the combined operation of a spinning machine and a winder.
FIG. 2 is an elevational view, partially in section and partially diagrammatic of a tube circulating system incorporating the preferred embodiment of the apparatus for providing a constant bobbin tube supply of the present invention.

Referring first to FIG. 1, the block designated by the reference numeral 1 symbolizes a spinning machine, and the block designated by the numeral 2 designates a textile winding machine. A transfer conveyor 3 is located between the two machines for transferring tubes therebetween. A tube circuit 9 is obtained by a horizontal conveyor 10, a tube delivery conveyor 11', the transfer conveyor 3, a tube return conveyor 11 and transfer conveyors 12 and 13. The horizontal conveyor 10 provides bobbin transport along and between the machines and is optionally guided through a conventional preparation station, not shown. The transverse conveyors 13 of the winder 2 deliver spent tubes to the tube delivery conveyor 11' that delivers the tubes to the transfer conveyor 3, from which the tubes are supplied to the return conveyor 11 that delivers the tubes to the spinning stations of the spinning machine 1. The bobbins of yarn wound on the tubes are fed by the transverse conveyors 12 of the spinning machine 1 to the horizontal conveyor 10 for delivery to the winder 2.

The tube return conveyor 11 and the tube delivery conveyor 11' are of conventional construction and operation. As seen in FIG. 2, the tube return conveyor 11 is a conveyor belt trained over rollers 18, and the tube delivery conveyor 11' is a conveyor belt trained over rollers 19.

The transfer conveyor 3 is a vertical elevator-type conveyor formed with tube receiving compartments defined by flights 21. It is trained around an idler roller 22 at the bottom and by a driven roller 23 at the top, which is driven by a conventional drive motor 40. The bottom roller 22 is mounted on the machine frame 25 and the driven roller 23 is mounted on a support 24.

A tube accumulating magazine 26 is mounted on the machine frame 25 and extends vertically for receiving and accumulating a supply of tubes 15 in a vertical column adjacent the ascending side of the transfer conveyor 3. A conventional ejecting mechanism is associated with the accumulating magazine 26, having a pivoted ejecting arm 31 movable transversely across the top of the return conveyor 11' adjacent the accumulating magazine 26 and actuated by a lever 27 of a pneumatic servomotor 28. The ejecting device acts to eject tubes individually and successively from the delivery conveyor 11' into the accumulating magazine 26.

Means are provided for discharging tubes singly from the accumulating magazine 26 onto the transfer conveyor 3. This means includes a lever 33 pivoted about a pivot pin 41 and actuated by a pneumatic servomotor 29 that is controlled by both a sensor 42 that senses the presence of a flight 21 of the transfer conveyor 3 approaching the accumulating magazine 26 and by a sensor 46 that senses the supply of tubes 17 on the return conveyor 11 to the spinning machine 1. Thus, when the supply sensor 46 senses a reduction in the supply of tubes 17 on the return conveyor 11, a signal is provided through electrical connection 43 to render the discharging means operable so that when the sensor 42 senses a flight 21 approaching the accumulating magazine 26, the servomotor 29 will be activated to pivot the lever 33 and discharge a tube 15 from the bottom of the magazine onto the conveyor flight for conveyance on the conveyor 3 around the upper roller 23 for discharge onto the return conveyor 11.

The supply sensor 46 can take any conventional form. For example, the return conveyor 11 may be mounted on a weighing device or the number of tubes can be determined photoelectrically. In any event, it is sufficient simply to determine the presence or absence of the last tube of a predetermined number of tubes in the series of tubes accumulated against the conventional stop flange of the spinning machine 1 against which the tubes 17 abut in position for discharge into the spinning machine 1 in a conventional manner, not shown.

In the event the accumulating magazine 26 is filled to capacity with tubes 15, a conventional sensor, not shown, de-activates the servomotor 28 that operates the ejector 31 and subsequent tubes 14 on the delivery conveyor 11' continue on the conveyor past the accumulating magazine and are dumped along the line designated by the reference numeral 48 into collecting means in the form of an overflow collector 47. Thus, the winder 2 can continue in operation even though tubes are not being circulated to the spinning machine 1 due to interruption in the spinning machine operation or to malfunctioning of the discharge lever 33 mechanism.

A reserve magazine 4 is mounted adjacent the transfer conveyor 3 on the support 24 above and downstream of the accumulating conveyor 26. This reserve magazine is vertically disposed for containing a reserve supply of tubes 16 for discharge onto the flights 21 of the transfer conveyor 3 upon activation of discharge means in the form of a lever 5 pivoted on pivot pin 6 and operated by a servomotor 30. The servomotor 30 is controlled by the aforementioned counter 46 that renders the servomotor 30 operable through electrical connection 44 at the same time that it renders operable the discharge mechanism for the accumulating magazine 26. The servomotor 30 is also controlled by a tube sensor 7 having a sensing finger 8 disposed slightly below and upstream of the associated discharge mechanism to sense whether a tube is in the approaching pocket of the transfer conveyor 3 and thereby actuate the servomotor 30 when the pocket is empty so that a tube 16 at the bottom of the shaft 49 of the reserve magazine 4 will be discharged into the empty compartment.

In operation of the apparatus as described, when the supply sensor 46 senses a reduction in the supply tubes 17 on the return conveyor 11, it renders both the discharge mechanism for the accumulating magazine 26 and the discharge mechanism for the reserve magazine 4 operable so that when a flight 21 of the transfer conveyor 3 is sensed by the sensor 42 the accumulating magazine discharge mechanism discharges a tube 15 onto the flight 21 and at a delay equivalent to the advance of the flight 21 to the reserve magazine 4 the sensor 7 will determine whether a tube had in fact been discharged onto the transfer conveyor by the accumulating magazine discharging mechanism. If it had, the discharging mechanism of the reserve magazine 4 is not operated, but if the sensor 7 detects the absence of a tube the discharging mechanism is activated so that all transfer conveyor compartments receive a tube either from the accumulating magazine 26 or the reserve magazine 4, with the feeding from the accumulating magazine 26 taking precedence over feeding from the reserve magazine 4.

The drive motor 40 for the transfer conveyor 3 is preferably controlled in response to the tube supply sensor 46 for intermittent operation of the transfer conveyor 3 when the sensor 46 detects a reduction in the supply of tubes 17 on the return conveyor 11. For this purpose the sensor 46 is electrically connected through line 45 to the motor 40.

When the supply sensor 46 again senses that the desired supply of tubes has been accumulated on the return conveyor 11, it de-activates the transfer conveyor motor 40 to stop the transfer conveyor 3 and also renders the two tube discharging mechanisms inoperative to stop feeding of tubes onto the transfer conveyor, with tubes continuing to be delivered on the delivery conveyor 11' from the winder being dumped into the overflow collector 47. Subsequently, when the tube supply is reduced on the return conveyor 11 the sensor 46 again activates the guide motor 40 for the transfer conveyor 3 and renders operable the tube discharging mechanisms.

The overflow collector 47 is periodically emptied into the reserve magazine 4, into which repaired or replacement tubes are also periodically introduced. Alternatively, the overflow collector 47 can be incorporated as a part of the reserve magazine 4 so that overflow tubes are fed automatically into the reserve magazine 4.

The reserve magazine 4 includes the aforementioned discharge shaft 49 and a supply magazine 50 that includes a removable tube container 53. This container 53 has side hooks 54,55 engageable over support plates 51,52 of the supply magazine 50.

The container 53 has a bottom 57 that is pivoted about a pivot connection 56 at one side of the container 53 for disposition of the bottom 57 at an inclination downwardly toward the other side of the container 53 in alignment with a slot 60 through which tubes 59 in the container 53 slide from the bottom 57 into the magazine shaft 49. Agitation of the tubes 59 in the container 53 to facilitate sliding movement through the slot 60 is accomplished by vibrating means in the form of an eccentric roller 61 disposed under the container bottom 57 and rotated by a conventional drive motor 62.

The slot 60 maybe closed by a latch 58 that can be swung over the slot and hooked under the adjacent edge of the container bottom 57 to prevent flow of tubes 59 through the slot 60. The slot is closed in this manner when the container 53 is not in the supply magazine 50 and is in some remote location where it is being filled with tubes, such as when it is used as the overflow collector 47 or is being filled where tubes are being repaired or cleaned preparatory to being reinserted in the circulating system.

The apparatus of the present invention has the important capability of operating automatically to initially charge the machines and circulating system with a sufficient supply of tubes for proper operation as when initially starting the machines or when changing size or type of tubes. For this purpose a tube counter 63 is mounted adjacent the transfer conveyor above and downstream from the discharge mechanism of the reserve magazine 4. This counter 63 has a display field 64 that is set to the number of tubes needed to fully charge the system. The counter 63 is connected by an electrical connection 66 to render the servomotor 30 of the discharging mechanism of the reserve magazine 4 operable to discharge tubes 16 from the reserve magazine 4 onto the passing flights 21. The counter 63 has a sensing finger 65 that projects into the path of tubes being transported on the transfer conveyor. Every time the sensing finger 65 senses a tube passing, the counter 63 reduces the number in the display field 64 and when the number in the display field reaches 0, indicating that the system has been fully charged with tubes, the counter 63 acts through the electrical connection 66 to terminate the operability of the servomotor 30 so that the apparatus can then function in the operating mode described above.

The counter can alternatively be mounted as indicated by the reference numeral 63' on the magazine shaft 49 to tubes 59 passing into the shaft 49 at a spacing from the discharge so that, in addition to fully charging the system, a selected reserve of tubes will be in the shaft 49 when the discharging mechanism is deactivated.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. An apparatus for providing a constant supply of circulating textile bobbin tubes from a delivery conveyor of a textile winding machine to a return conveyor of a textile spinning machine, said apparatus comprising a transfer conveyor for transferring tubes from said delivery conveyor to said return conveyor, a tube accumulating magazine disposed adjacent said transfer conveyor for receipt and accumulation of tubes delivered thereto by said delivery conveyor, means for discharging tubes singly from said accumulating magazine onto said transfer conveyor, a tube reserve magazine disposed adjacent said transfer conveyor downstream of said accumulating conveyor for containing a reserve supply of tubes, means for discharging tubes singly from said reserve magazine onto said transfer conveyor, means for sensing the supply of tubes on said return conveyor and for rendering said accumulating magazine discharging means and said reserve magazine discharging means operable in response to a reduction in the supply of tubes on said return conveyor, means for activating operation of said accumulating magazine discharging means in timed relation to advance of said transfer conveyor when said discharging means is rendered operable, means for activating operation of said reserve magazine discharging means to feed an initial supply of tubes to said machines and conveyors, said initial activating means including a tube counter operable to de-activate said initial activating means upon counting discharge of a selected number of tubes, and means for activating operation of said reserve magazine discharging means in response to the absence of discharge of a tube onto said transfer conveyor by said accumulating magazine discharging means.

2. An apparatus for providing a constant supply of circulating textile bobbin tubes from a delivery conveyor of a textile winding machine to a return conveyor of a textile spinning machine, said apparatus comprising a transfer conveyor for transferring tubes from said delivery conveyor to said return conveyor, a tube accumulating magazine disposed adjacent said transfer conveyor for receipt and accumulation of tubes delivered thereto by said delivery conveyor, means for discharging tubes singly from said accumulating magazine onto said transfer conveyor, a tube reserve magazine disposed adjacent said transfer conveyor downstream of said accumulating conveyor for containing a reserve supply of tubes, means for discharging tubes singly from said reserve magazine onto said transfer conveyor, means for sensing the supply of tubes on said return conveyor and for rendering said accumulating magazine discharging means and said reserve magazine discharging means operable in response to a reduction in the supply of tubes on said return conveyor, means for activating operation of said accumulating magazine discharging means in timed relation to advance of said transfer conveyor when said discharging means is rendered operable, means for activating operation of said reserve magazine discharging means to feed an initial supply of tubes to said machines and conveyors, said initial activating means including a tube counter operable to de-activate said initial activating means upon counting discharge of a selected number of tubes and means for activating operation of said reserve magazine discharging means in response to the absence of discharge of a tube onto said transfer conveyor by said accumulating magazine discharging means.

3. An apparatus according to claim 2 and characterized further in that said means for activating operation of said reserve magazine discharging means in response to the absence of a tube on the transfer conveyor acts in delayed timed relation to advance of said transfer conveyor from said accumulating magazine to said reserve magazine.

4. An apparatus according to claim 2 and characterized further by means for collecting tubes from said delivery conveyor when said accumulating magazine is full.

5. An apparatus according to claim 4 and characterized further in that said overflow collecting means is connected to said reserve magazine for feed of overflow of tubes from said return tube to said reserve magazine.

6. An apparatus according to claim 4 and characterized further in that said overflow collecting means is disposed for emptying into said reserve magazine.

7. An apparatus according to claim 3 and characterized further in that said transfer conveyor is a compartmented conveyor having compartments for individual tubes, and said delayed activating means includes means for sensing the absence of a tube in a compartment of said transport conveyor between said accumulating magazine discharging means and said reserve magazine discharging means.

8. An apparatus according to claim 2 and characterized further by means for advancing said transfer conveyor in response to said means for sensing the supply of tubes on said return conveyor.

9. An apparatus according to claim 2 and characterized further in that said reserve magazine includes a removable container for said tubes.

10. An apparatus according to claim 2 or 9 and characterized further in that said reserve magazine has a slot and includes a movably inclined bottom portion adjacent said slot and by means of vibrating said movable bottom portion to facilitate movement of tubes from said bottom through said slot.

11. An apparatus according to claim 10 and characterized further by means for selectively closing said slot.

12. An apparatus for providing a constant supply of circulating textile bobbin tubes from a delivery conveyor of a textile winding machine to a return conveyor of a textile spinning machine, said apparatus comprising a transfer conveyor for transferring tubes from said delivery conveyor to said return conveyor, a tube accumulating magazine disposed adjacent said transfer conveyor for receipt and accumulation f tubes delivered thereto by said delivery conveyor, means for discharging tubes singly from said accumulating magazine onto said transfer conveyor, a tube reserve magazine disposed adjacent said transfer conveyor downstream of said accumulating conveyor for containing a reserve supply of tubes, means for discharging tubes singly from said reserve magazine onto said transfer conveyor, means for sensing the supply of tubes on said return conveyor and for rendering said accumulating magazine discharging means and said reserve magazine discharging means operable in response to a reduction in the supply of tubes on said return conveyor, means for activating operation of said accumulating magazine discharging means in timed relation to advance of said transfer conveyor when said discharging means is rendered operable, means for activating operation of said reserve magazine discharging means to feed an initial supply of tubes to said machines and conveyors, said initial activating means including a tube counter operable to de-activate said initial activating means upon counting discharge of a selected number of tubes, said tube counter being mounted adjacent said reserve magazine for counting tubes passing therethrough for de-activation of said reserve magazine discharging means with a selected supply of tubes in said reserve magazine and means for activating operation of said reserve magazine discharging means in response to the absence of discharge of a tube onto said transfer conveyor by said accumulating magazine discharging means.

* * * * *